US011846030B2

(12) United States Patent
Cox

(10) Patent No.: US 11,846,030 B2
(45) Date of Patent: Dec. 19, 2023

(54) CORROSION RESISTANT BIMETAL

(71) Applicant: Naval Information Warfare Center Pacific, San Diego, CA (US)

(72) Inventor: Stephen Charles Cox, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 173 days.

(21) Appl. No.: 17/411,342

(22) Filed: Aug. 25, 2021

(65) Prior Publication Data

US 2023/0060648 A1 Mar. 2, 2023

(51) Int. Cl.
*C23F 13/16* (2006.01)

(52) U.S. Cl.
CPC ..... *C23F 13/16* (2013.01); *Y10T 428/12736* (2015.01)

(58) Field of Classification Search
None
See application file for complete search history.

(56) References Cited

U.S. PATENT DOCUMENTS

| | | | | |
|---|---|---|---|---|
| 10,500,674 | B2 | 12/2019 | Kandasamy et al. | |
| 10,583,631 | B2 | 3/2020 | Kandasamy et al. | |
| 2003/0031892 | A1* | 2/2003 | Fujita | B32B 15/012 428/629 |
| 2017/0225265 | A1* | 8/2017 | Ito | B23K 20/1265 |
| 2017/0304933 | A1* | 10/2017 | Miles | B23K 20/122 |

OTHER PUBLICATIONS

Rumble, ed., "Van der Waals and Covalent Radii of the Elements", 2022, CRC Handbook of Chemistry and Physics, 103rd Edition (Internet version) (Year: 2022).*

* cited by examiner

*Primary Examiner* — Seth Dumbris
(74) *Attorney, Agent, or Firm* — Naval Information Warfare Center, Pacific; Kyle Eppele; Matthew D. Pangallo

(57) ABSTRACT

A corrosion resistant bimetal includes a part and one or more sacrificial anodes. The part includes a metal component that is susceptible to corrosion. The sacrificial anodes consists of an attachment to the part through a metallic bond between the metal component and the sacrificial anode to form a crystalline solid that includes the sacrificial anode and the metal component of the part.

13 Claims, 8 Drawing Sheets

CORROSION RESISTANT BIMETAL

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND

Corrosion of metals on equipment, vehicles, devices, aircraft, etc. due to salt fog, seawater splash, and immersion cost millions of dollars per year to repair. Conventional mitigation methods include galvanic protection using the sacrificial anodes. Sacrificial anodes are highly active metals that are used to prevent a less active metal surface from corroding. Sacrificial anodes are created from a metal or metal alloy with a more negative electrochemical potential than the structural metal being protected. For example, ships, which are typically constructed with steel alloy, are constantly exposed to seawater (i.e., an electrolyte), which corrodes the ship hull. A sacrificial anode is used to prevent the corrosion of the ship hull from the seawater by being mechanically attached to the ship, thereby oxidizing completely before the ship metal begins to oxidize.

DESCRIPTION OF THE DRAWINGS

Features and advantages of examples of the present disclosure will be apparent by reference to the following detailed description and drawings, in which like reference numerals correspond to similar, but in some instances, not identical, components. Reference numerals or features having a previously described function may or may not be described in connection with other drawings in which they appear.

DETAILED DESCRIPTION

Figure 1:
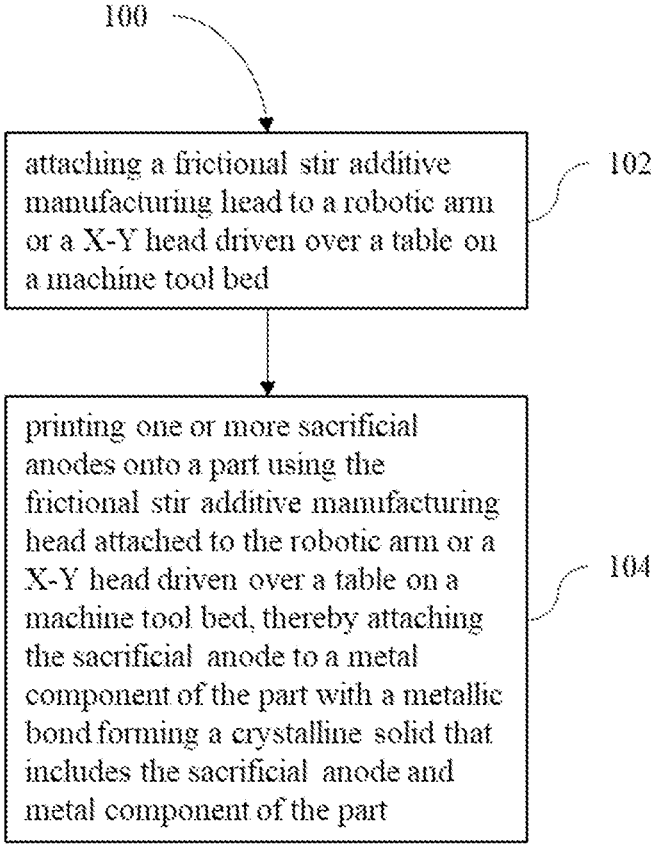
FIG. 1 is an example of a method for making a corrosion resistant bimetal.

Currently, sacrificial anodes are used to prevent corrosion. The sacrificial anodes are mechanically fastened to the metal being protected from corrosion. For example, the sacrificial anodes are commonly used in ships by mechanically fastening the sacrificial anodes to the ship hull to prevent corrosion. The sacrificial anode is generally a zinc anode that is mechanically, either directly or through wires leads, fastened to the ship hull. The first issue with using mechanical fasteners to attach sacrificial anodes is that the sacrificial anodes either do not have or lose sufficient electrical contact, and therefore lose electrical conductivity rendering the anodes ineffective. Once the electrical contact is insufficient, the metal being protected from corrosion begins to corrode (e.g., the ship hull). The second issue with mechanically fastening sacrificial anodes is that, in some instances, the sacrificial anode can only be composed of specific material. For example, aluminum sacrificial anodes would perform better than zinc anodes on ship hulls. However, aluminum sacrificial anodes are not used because of the difficulty with creating and maintaining the electrical connection between two dissimilar metals (i.e., the ship hull and aluminum sacrificial anode). Therefore, the sacrificial anode is composed of a less effective material.

Another issue with the sacrificial anodes is that smaller metal parts that are susceptible to corrosion often do not have any type of sacrificial anode attached. This is because a part may be too small to mechanically fasten the sacrificial anode to the part. To address this, multiple parts are built into the assembly of an object for the same purpose such that when one part fails to corrosion there is another part already attached as part of the assembly. However, these corroded smaller parts contribute to electrical resistance, which reduces the effectiveness of the sacrificial anode. Lastly, similar to metal parts being too small for sacrificial anodes, older legacy parts that are no longer produced cannot be remade to include sacrificial anodes. Therefore, the legacy parts will eventually corrode with no protection.

In contrast, a corrosion resistant bimetal herein includes one or more sacrificial anodes that are attached to the metal component of a part with metallic bonds to form a crystalline solid. As such, none of the deficiencies of mechanical fasters exists. There is no issue with losing electrical contact as the electrical contact is maintained until the sacrificial anode is completely exhausted. The sacrificial anode is printed onto the metal component of a part using frictional stir additive manufacturing (FSAM). Therefore, any metal capable of being printed using FSAM may be used as the sacrificial anode, which means the sacrificial anode may be composed of the best material for a particular application. Additionally, the precision of FSAM allows small parts susceptible to corrosion to be made with a built-in sacrificial anode to prevent corrosion. This reduces the number of smaller parts needed in a bigger assembly (e.g., a ship, submarine, etc.) in addition to adding corrosion protect for previously unprotected small parts. Similarly, legacy parts may also either be produced with built-in sacrificial anodes or by printing an anode directly onto the legacy part. All of these improvements significantly extend the life of metal parts and reduce the cost to repair or replace parts due to corrosion.

The corrosion resistant bimetal herein includes a part and one or more sacrificial anodes. The part includes a metal component that is susceptible to corrosion. The sacrificial anode consists of an attachment to the part through a metallic bond between the metal component and the sacrificial anode to form a crystalline solid that includes the sacrificial anode and the metal component of the part.

The part includes a metal component that is susceptible to corrosion. The part may be a metal component that is at least a portion of a mechanical or electrical object. Some examples of the part include a ship or a ship component (e.g., a hull, shipboard components, etc.), a marine growth preventive system, a vehicle or vehicle component, an aircraft or aircraft component, outdoor building components, radios, antennas, trains, buoys, submarines, electrical cabinets, I-beams, transmission towers, or legacy components of any of the previous examples. The metal component on the part may be composed of any metal or metal alloy. Some examples of the metal component include magnesium, aluminum, zinc, chromium, iron, copper, steel, and alloys thereof.

The one or more sacrificial anodes consist of an attachment to the part through a metallic bond between the metal component and the sacrificial anode to form a crystalline solid that includes the sacrificial anode and the metal component of the part. The sacrificial anodes do not require any type of mechanical fastener to attach to the part. The sacrificial anodes are only attached to the part through the metallic bonds. The sacrificial anodes may be composed of any metal that has a higher electronegativity than the metal component of the part where the standard reduction potential between the sacrificial anode and the metal component ranges from about 0.3V to about 3.0V. For example, steel, with standard reduction potential of −0.447, protects copper, which has a standard reduction potential of −0.153. In another example, zinc, which has a standard reduction potential of −0.762 protects steel. The larger the difference in the standard reduction potential between the metal component and the sacrificial anode, the better protection against corrosion the part will have. However, the larger the difference in the standard reduction potential between the metal component and the sacrificial anode, the shorter the life of the sacrificial will be until the sacrificial anode is depleted. In some examples, the anode may be any metal that is more electronegative than the metal component of the part. Some examples of the sacrificial anode metal include magnesium, aluminum, zinc, chromium, iron, copper, steel, and alloys thereof.

The thickness, cross-sectional diameter, and length of the sacrificial anode may vary depending on the application and the number of sacrificial anodes being used. For example, an engine block may require only one sacrificial anode that is about 2 $in^2$ to about 3 $in^2$ while a ship hull may require one sacrificial anode that is about 2 $ft^2$ to about 3 $ft^2$. In some examples, each individual sacrificial anode has a thickness equal to or greater than 0.05 inches, a cross-sectional diameter equal to or greater than 1 inch, and a length equal to or less than 30 ft. In addition, each sacrificial anode is replaceable by adding additional layers of the sacrificial anode over the existing or depleted sacrificial anode or adding the sacrificial anode to another area of the metal component of the part.

There may be additional factors to consider when selecting the sacrificial anode metal. In some examples, the metal of the sacrificial anode is selected using the Hume-Rothery rules for substitutional solids or interstitial solids. For example, the metal of the sacrificial anode and the metal component of the part are substitutional solids and have a difference in atomic radius equal to or less than 15%. In other examples, the metal of the sacrificial anode and the metal component of the part have the same valence.

An intermediate metal layer may be used in the corrosion resistant bimetal. In some examples, an intermediate metal layer may be added for engineering reasons. In another example, an intermediate metal layer may be added to satisfy the Hume-Rothery rules so a sacrificial anode may be added to the metal component of the part that previously could not form a metallic bond to the sacrificial anode without the intermediate metal layer. One or more intermediate metal layers may be used either as a bonding layer when two metals cannot form a metallic bond or for engineering purposes, such as a stress gauge layer, an abrasive resistance layer, etc. For example, the corrosion resistant bimetal includes an intermediate metal layer that is attached to both the metal component of the part on a first side and the sacrificial anode on the second side through metallic bonds to form a crystalline solid that includes the metal component, the intermediate metal layer, and the sacrificial anode. The intermediate metal layer may be any metal that has an atomic radius equal to or less than 15% of both the metal component of the part and the sacrificial anode and has a higher electronegativity than the metal component of the part. For example, the intermediate metal layer is used to bond the metal component and the sacrificial anode when the sacrificial anode has insufficient bond strength to form a metallic bond directly to the metal component of the part. In another example, an interstitial metal application may be used for part level application. For example, if the metal component of a part was copper alloy and a desired material for the sacrificial anode is a molybdenum alloy, the metal component and the sacrificial anode cannot form a metallic bond. An intermediate metal layer of nickel or cobalt may be used to form two metallic bonds, one metallic bond with the copper alloy and another metallic bond with the molybdenum alloy. Some specific examples of the intermediate metal layer include nickel, cobalt, and alloys thereof.

Referring now to FIG. 1, a method 100 for making the corrosion resistant bimetal disclosed herein is shown. The method includes 102 attaching a frictional stir additive manufacturing head to a robotic arm or a X-Y head driven over a table on a machine tool bed. In an example, the frictional stir additive manufacturing head has a downforce ranging from about 1000 psi to about 5000 psi depending on the application. In some examples, the frictional stir additive manufacturing head has a rotational speed ranging from about 200 RPM to about 300 RPM depending on the application. The robotic arm may be any known robotic arm that is suitable for a particular application. For example, an industrial robotic arm may be used.

Referring back to FIG. 1, the method 100 includes 104 printing one or more sacrificial anodes onto a part using the frictional stir additive manufacturing head attached to the robotic arm or a X-Y head driven over a table on a machine tool bed, thereby attaching the sacrificial anode to a metal component of the part with a metallic bond forming a crystalline solid that includes the sacrificial anode and metal component of the part. The metallic bond is the only means of attachment between the sacrificial anode and the metal component of the part. The part includes a metal component that is at least a portion of a mechanical or electrical object. The metal component of the part may be composed of the same metal as previously disclosed herein. Similarly, the sacrificial anode may be composed of the same metal as previously disclosed herein with a higher electronegativity than the metal component of the part. In some examples, the sacrificial anode is printed directly onto the metal component of the part. In other examples, a new sacrificial anode is printed onto an existing or depleted sacrificial anode. In some examples, when printing the one or more sacrificial anodes, the deposition rate ranges from about 1 lbs/hr to about 20 lbs/hr.

In some examples, the method 100 further includes printing an intermediate metal layer prior to printing the sacrificial anode, thereby attaching the intermediate metal layer to the metal component of the part with the crystalline bond and attaching the sacrificial anode to the intermediate metal layer with a second crystalline bond. The sacrificial anode is printed onto the intermediate metal layer after the intermediate metal layer has been printed onto the metal component of the part. The intermediate layer may be the same intermediate metal layer as previously described herein.

Figure 6A:
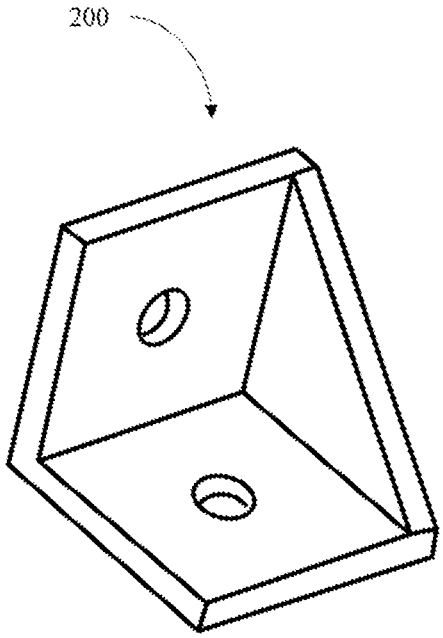
FIG. 6A-6B is another example of a bimetal without corrosion resistance and the corrosion resistant bimetal described herein, respectively.
Figure 6B:
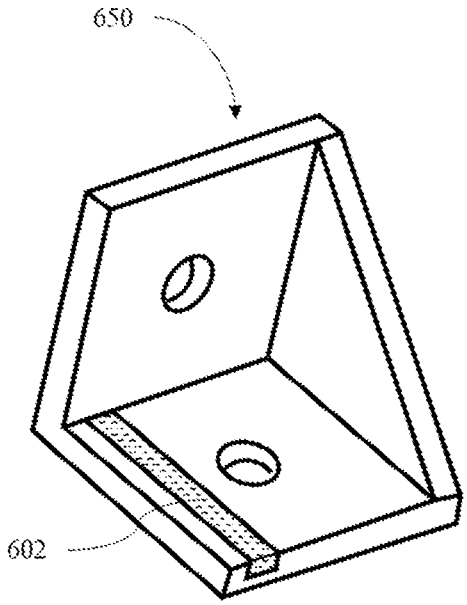
Figure 7A:
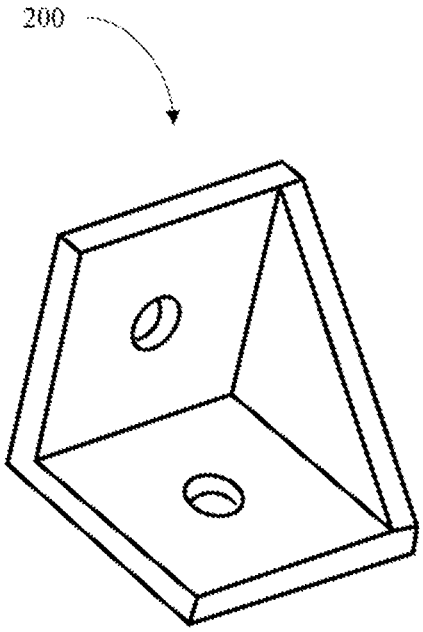
FIG. 7A-7B is another example of a bimetal without corrosion resistance and the corrosion resistant bimetal described herein, respectively.
Figure 7B:
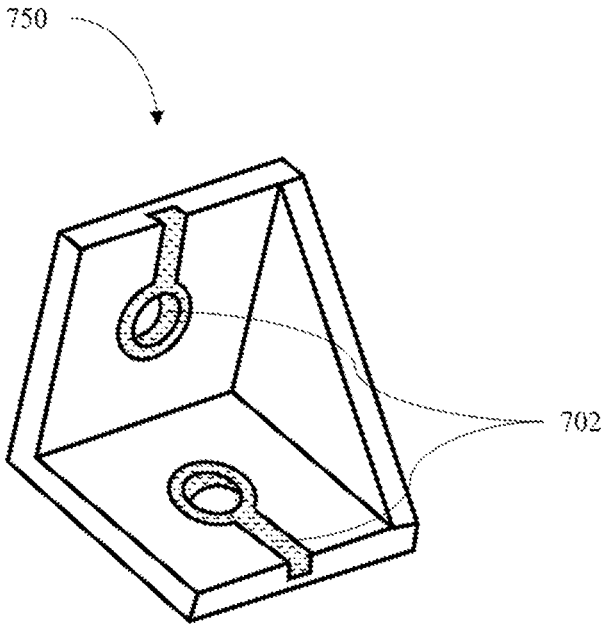
Figure 8:
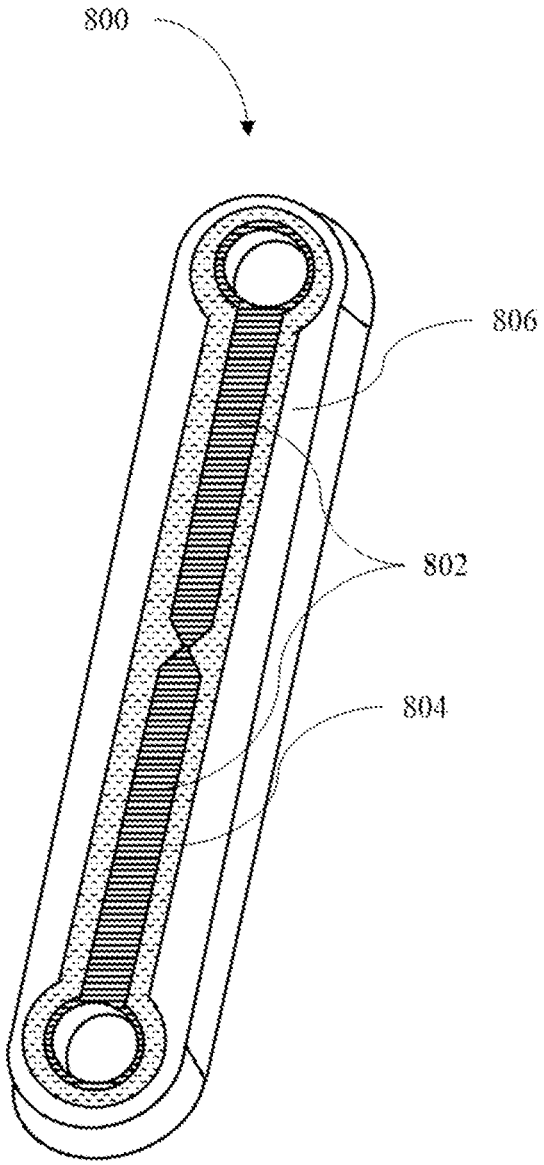
FIG. 8 is an example of a smart part that may function as another example of the corrosion resistant bimetal described herein.

Referring now to FIG. 2A-FIG. 8, different examples of corrosion resistant bimetals are shown. In FIG. 2A-FIG. 7B, different examples of parts where the entire part is composed of the metal component are shown. Each example has a part before adding a sacrificial anode (e.g., FIGS. 2A, 3A, 4A, 5A, 6A, and 7A) and after adding a sacrificial anode (e.g., FIGS. 2B, 3B, 4B, 5B, 6B, and 7B). FIG. 8 is a smart part that may be another example of a corrosion resistant bimetal where the part is composed entirely of the metal component and includes a sacrificial anode. FIG. 2A-FIG. 8 include hatching patterns, which are for illustrative purposes only to aid in viewing and should not be construed as being limiting or directed to a particular material or materials.

Figure 2A:
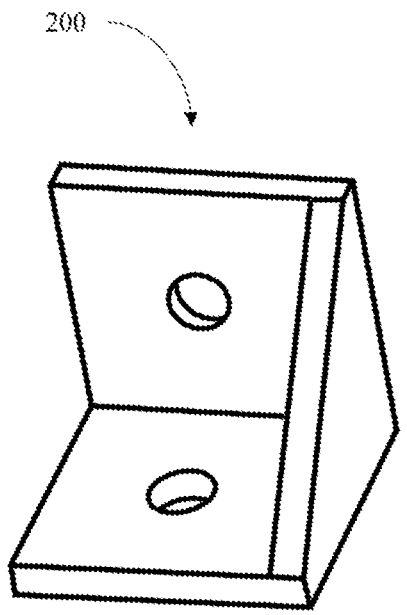
FIG. 2A-2B is an example of a bimetal without corrosion resistance and the corrosion resistant bimetal described herein, respectively.
Figure 2B:
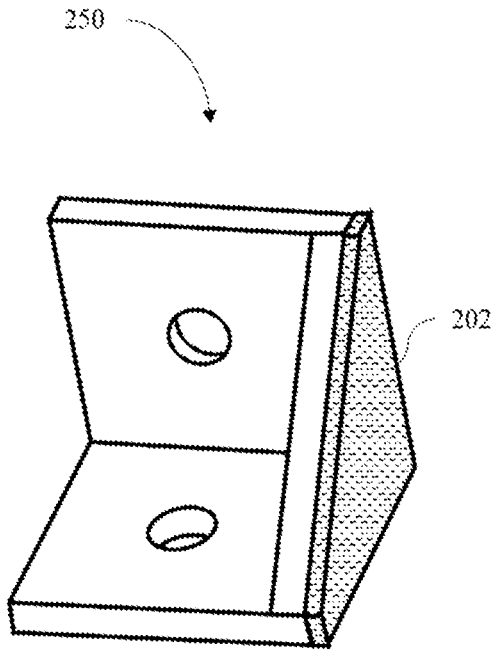

FIGS. 2A and 2B are an example of an angle bracket including a gusset without a sacrificial anode 200 and an angle bracket including a gusset with a sacrificial anode side layer 250, respectively. If the angle bracket including the gusset 200 were a legacy part to be enhanced, it would be clamp secured to a machine build table, in an FSAM machine for example, for single layer deposition to form the angle bracket including the gusset with a sacrificial anode side layer 250. Then, depending on requirements of end use assembly, the angle bracket including the gusset with a sacrificial anode side layer 250 may remain secured for secondary computer numerical control (CNC) operation, providing smooth finish surfaces if the sacrificial anode 202 is not being deposited on an external surface, thereby forming the angle bracket including the gusset with the sacrificial anode side layer 250. If deposition of the sacrificial anode 202 is on an external surface as shown in FIG. 2B, then the sacrificial anode 202 remains external in the final assembly with no secondary operation. If the angle bracket including the gusset with the sacrificial anode side layer 250 is being produced as a brand new part, the fabrication operation would be two stage. The first stage would producing the angle bracket including the gusset shown in FIG. 2A. Then, a change of material, to print the sacrificial anode 202, in this example as a side layer on the gusset.

Figure 3A:
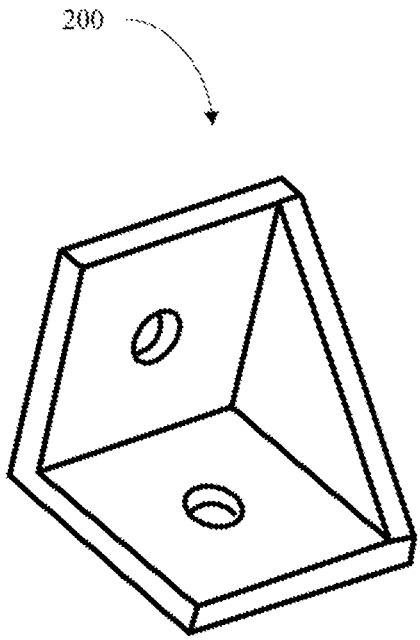
FIG. 3A-3B is another example of a bimetal without corrosion resistance and the corrosion resistant bimetal described herein, respectively.
Figure 3B:
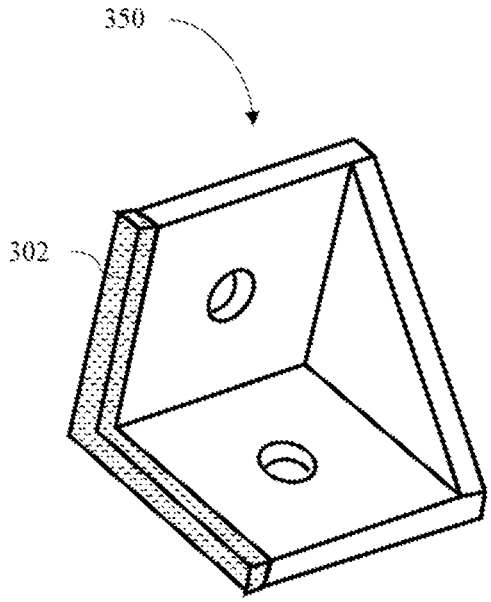

Referring now to FIGS. 3A and 3B, an example of an angle bracket including a gusset without a sacrificial anode 200 and an angle bracket including a gusset with a sacrificial anode edge layer 350, respectively. The angle bracket including the gusset with a sacrificial anode edge layer 350 may be produced as previously described herein for FIG. 2B. In an example, the angle bracket including the gusset with a sacrificial anode edge layer 350 may be a legacy part with the sacrificial anode 302 added onto the legacy part. In another example, the angle bracket including the gusset with a sacrificial anode edge layer 350 may be a new part produced as previously described herein in FIG. 2B.

Figure 4A:
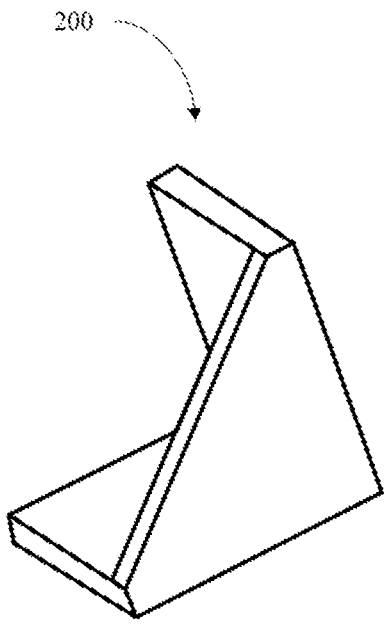
FIG. 4A-4B is another example of a bimetal without corrosion resistance and the corrosion resistant bimetal described herein, respectively.
Figure 4B:
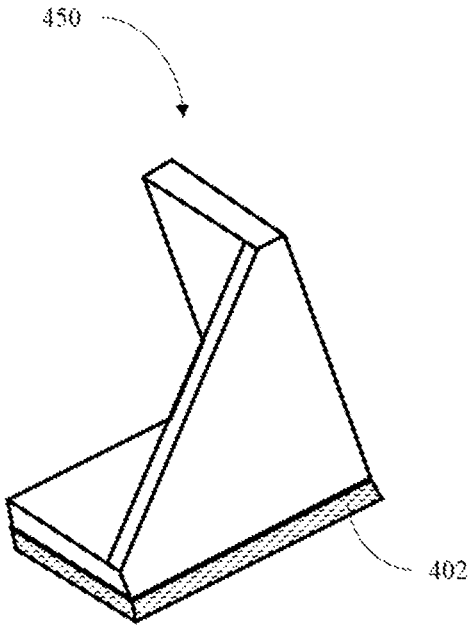

In another example, FIGS. 4A and 4B show an example of an angle bracket including a gusset without a sacrificial anode 200 and an angle bracket including a gusset with a sacrificial anode contact surface layer 450, respectively. The angle bracket including the gusset with a sacrificial anode contact surface layer 450 may be produced as previously described herein for FIG. 2B. In an example, the angle bracket including the gusset with a sacrificial anode contact surface layer 450 may be a legacy part with the sacrificial anode 402 added onto the legacy part. In another example, the angle bracket including the gusset with a sacrificial anode contact surface layer 450 may be a new part produced as previously described herein in FIG. 2B.

Figure 5A:
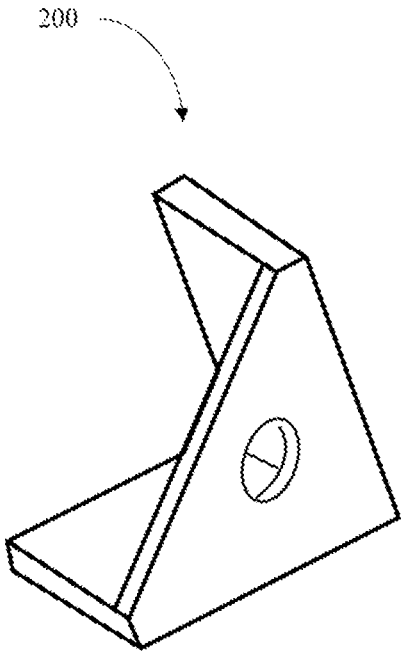
FIG. 5A-5B is another example of a bimetal without corrosion resistance and the corrosion resistant bimetal described herein, respectively.
Figure 5B:
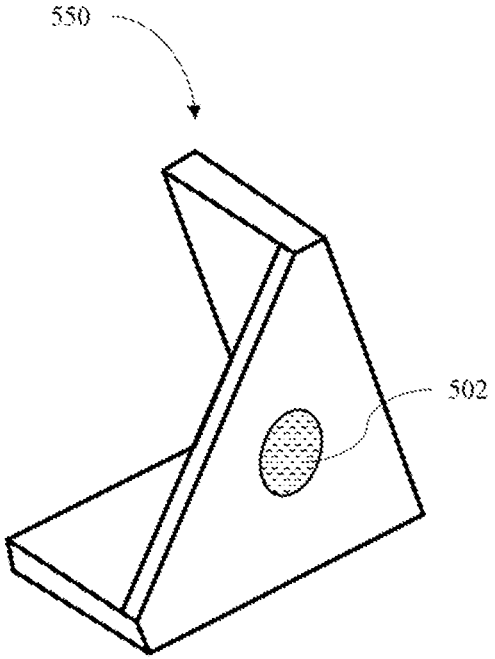

In yet another example, FIGS. 5A and 5B show an example of an angle bracket including a gusset without a sacrificial anode 200 and an angle bracket including a gusset with a sacrificial anode plug fill 550, respectively. The angle bracket including the gusset with a sacrificial anode plug fill 550 may be produced as previously described herein for FIG. 2B. In an example, the angle bracket including the gusset with a sacrificial anode plug fill 550 may be a legacy part with the sacrificial anode 502 added onto the legacy part. In another example, the angle bracket including the gusset with a sacrificial anode plug fill 550 may be a new part produced as previously described herein in FIG. 2B.

In another example, FIGS. 6A and 6B show an example of an angle bracket including a gusset without a sacrificial anode 200 and an angle bracket including a gusset with a sacrificial anode strip fill 650, respectively. The angle bracket including the gusset with a sacrificial anode strip fill 650 may be produced as previously described herein for FIG. 2B. In an example, the angle bracket including the gusset with a sacrificial anode strip fill 650 may be a legacy part with the sacrificial anode 602 added onto the legacy part. In another example, the angle bracket including the gusset with a sacrificial anode strip fill 650 may be a new part produced as previously described herein in FIG. 2B.

FIGS. 7A and 7B are an example of an angle bracket including a gusset without a sacrificial anode 200 and an angle bracket including a gusset with a sacrificial anode ring fill 750, respectively. The angle bracket including the gusset with a sacrificial anode ring fill 750 may be produced as previously described herein for FIG. 2B. In an example, the angle bracket including the gusset with a sacrificial anode ring fill 750 may be a legacy part with the sacrificial anode 702 added onto the legacy part. In another example, the angle bracket including the gusset with a sacrificial anode ring fill 750 may be a new part produced as previously described herein in FIG. 2B.

In another example of the corrosion resistant multi-metal, FIG. 8 shows a smart part that includes a sacrificial anode 800. Some applications of which the smart part may be in addition to a corrosion resistant multi-metal include a thermocouple, a thermopile, a Peltier junction, a humidity indicator, a stress gauge, or a strain memory element. In this example, the smart part 800 may be composed of steel as the outermost layer 806, a more highly resistive metal as the intermediate layer 804, and an innermost layer 802 of copper as the dominant conductor across the part. In the example shown in FIG. 8, the innermost layer 802 of copper would show stresses as increasing and decreasing resistance in linkage "push-pull" operation. Stresses would also show statically as a permanent resistance change if the linkage is over stressed, becoming a memory element. If the smart part 800 includes a built in sacrificial anode layer, the smart part 800 may be monitored in-situ, as electrical resistance dynamically between the fastener points if the smart part 800 is externally accessible. If the smart part 800 is inaccessible during operation, (e.g., a transmission), the smart part 800 may be removed and measured statically. The change in electrical resistance will indicate the stresses to which the smart part 800 was subjected.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of a list should be construed as a de facto equivalent of any other member of the same list merely based on their presentation in a common group without indications to the contrary.

Unless otherwise stated, any feature described herein can be combined with any aspect or any other feature described herein.

Reference throughout the specification to "one example", "another example", "an example", means that a particular element (e.g., feature, structure, and/or characteristic) described in connection with the example is included in at least one example described herein, and may or may not be present in other examples. In addition, the described elements for any example may be combined in any suitable manner in the various examples unless the context clearly dictates otherwise.

The ranges provided herein include the stated range and any value or sub-range within the stated range. For example, a range from about 0.3V to about 3.0V should be interpreted to include not only the explicitly recited limits of from about 0.3V to about 3.0V, but also to include individual values, such as 1.0V, 2.0V, 2.5V, etc., and sub-ranges, such as from about 0.5V to about 1.5V, etc.

In describing and claiming the examples disclosed herein, the singular forms "a", "an", and "the" include plural referents unless the context clearly dictates otherwise.

What is claimed is:

1. A corrosion resistant bimetal, comprising:

a part, wherein the part includes a metal component that is susceptible to corrosion; and one or more sacrificial anodes, wherein the sacrificial anodes consist of an attachment to the part through a metallic bond between the metal component and the sacrificial anode to form a crystalline solid that includes the sacrificial anode and the metal component of the part and the sacrificial anode has a higher electronegativity than the metal component of the part.

2. The corrosion resistant bimetal of claim 1, wherein the sacrificial anode has a change in standard reduction potential between the sacrificial anode and the metal component ranges from about 0.3V to about 3.0V.

3. The corrosion resistant bimetal of claim 1, wherein the sacrificial anode is a metal selected from the group consisting of magnesium, aluminum, zinc, chromium, iron, copper, steel, and alloys thereof.

4. The corrosion resistant bimetal of claim 1, wherein the metal component of the part is at least a portion of a mechanical or electrical object.

5. The corrosion resistant bimetal of claim 1, wherein the metal component of the part is a metal selected from the group consisting of magnesium, aluminum, zinc, chromium, iron, copper, steel, and alloys thereof.

6. The corrosion resistant bimetal of claim 1, wherein the sacrificial anode is replaceable by adding additional layers of the sacrificial anode over the existing or depleted sacrificial anode or adding the sacrificial anode to another area of the metal component of the part.

7. The corrosion resistant bimetal of claim 3, wherein the metal of the sacrificial anode and the metal component of the part are substitutional solids and have a difference in atomic radius equal to or less than 15%.

8. The corrosion resistant bimetal of claim 3, wherein the metal of the sacrificial anode and the metal component of the part have the same valence.

9. The corrosion resistant bimetal of claim 1, further including one or more intermediate metal layers, wherein the intermediate metal layers are attached to both the metal component of the part on a first side and the sacrificial anode on a second side through metallic bonds.

10. The corrosion resistant bimetal of claim 9, wherein the intermediate metal layer is a metal that has an atomic radius equal to or less than 15% of both the metal component of the part and the sacrificial anode.

11. The corrosion resistant bimetal of claim 1, wherein the sacrificial anode has a thickness equal to or greater than 0.05 inches, a cross-sectional diameter equal to or greater than 1 inch, and a length equal to or less than 30 ft.

12. The corrosion resistant bimetal of claim 9, wherein the part is a smart part with a steel outermost layer, the intermediate layer that is a more highly resistive metal than the steel outermost layer, and a copper innermost layer.

13. The corrosion resistant bimetal of claim 1, wherein the sacrificial anode is a side layer of the part, an edge layer of the part, a contact surface layer of the part, a plug fill of the part, a strip fill of the part, a ring fill of the part, or a combination thereof.

* * * * *